United States Patent [19]

Wigdahl

[11] 4,281,604

[45] Aug. 4, 1981

[54] DOMESTIC BOILER

[76] Inventor: Arthur G. Wigdahl, West Salem, Wis.

[21] Appl. No.: 118,846

[22] Filed: Feb. 5, 1980

Related U.S. Application Data

[63] Continuation-in-part of Ser. No. 964,432, Nov. 28, 1978.

[51] Int. Cl.[3] ..... F23B 7/00

[52] U.S. Cl. ..... 110/234; 122/20 A; 126/151

[58] Field of Search ..... 122/20 A, 20 B, 37, 122/33, 115, 4 A, DIG. 14; 110/317, 300, 234; 126/144, 147, 151

[56] References Cited

U.S. PATENT DOCUMENTS

| | | | |
|---|---|---|---|
| 1,133,612 | 3/1915 | Brown | 126/145 |
| 1,649,610 | 11/1927 | McGuane | 122/20 A |

*Primary Examiner*—Edward G. Favors
*Attorney, Agent, or Firm*—B. P. Fishburne, Jr.

[57] ABSTRACT

A boiler construction is disclosed which eliminates the need for bolting together of internal parts thereby greatly facilitating mass production and rapid assembly procedures. Internal side protectors, in addition to establishing the size of the boiler in the front-to-back direction, serve as support rails for a removable boiler module and as a retainer for fire bricks which are further retained by a firebox grate. Front and back protectors for the boiler interior rest upon the grate support members and are maintained in properly spaced relationship through interfitment with the side protectors. A boiler scraping attachment and boiler tube cleaner are disclosed. A positive releasable retainer arrangement for the slide-in, slide-out boiler module is included.

9 Claims, 8 Drawing Figures

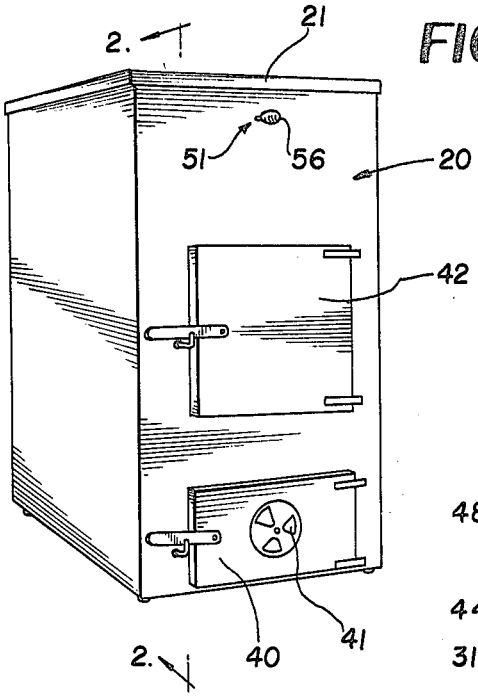
FIG. 1
FIG. 5
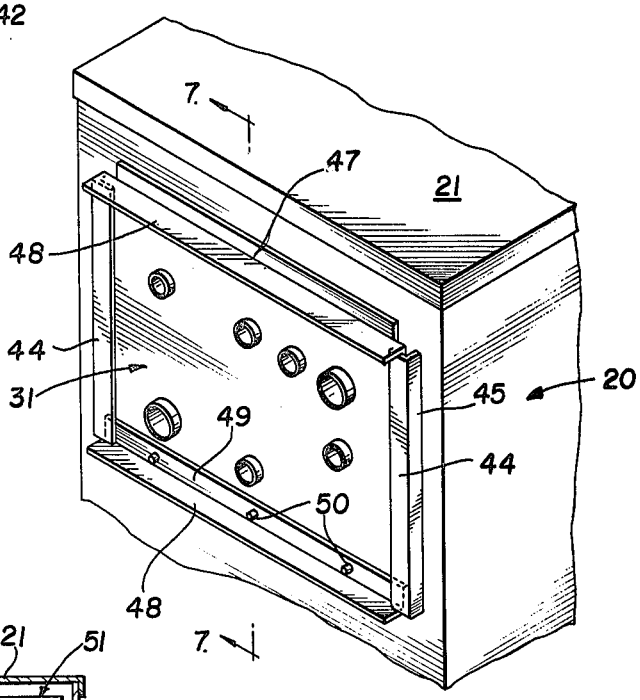
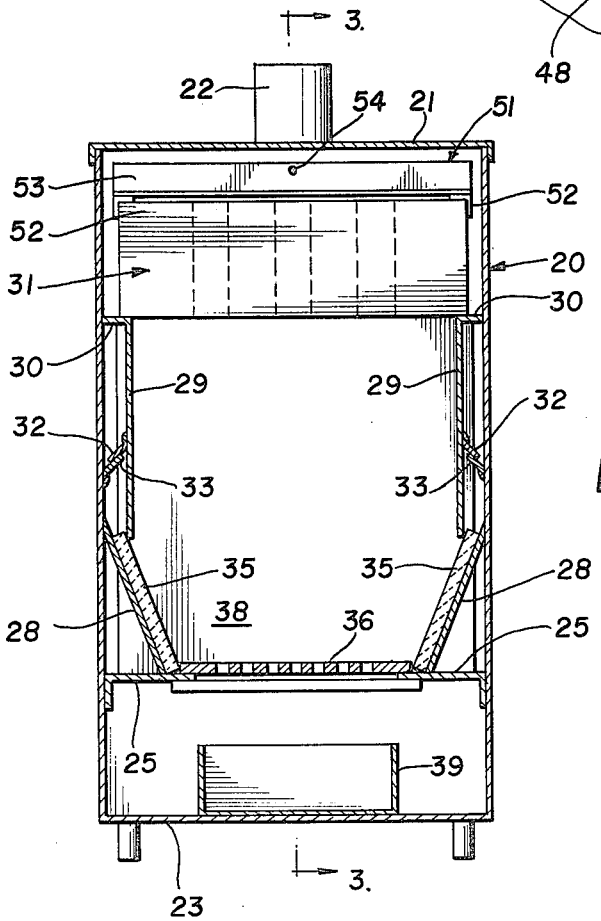
FIG. 2

FIG. 6
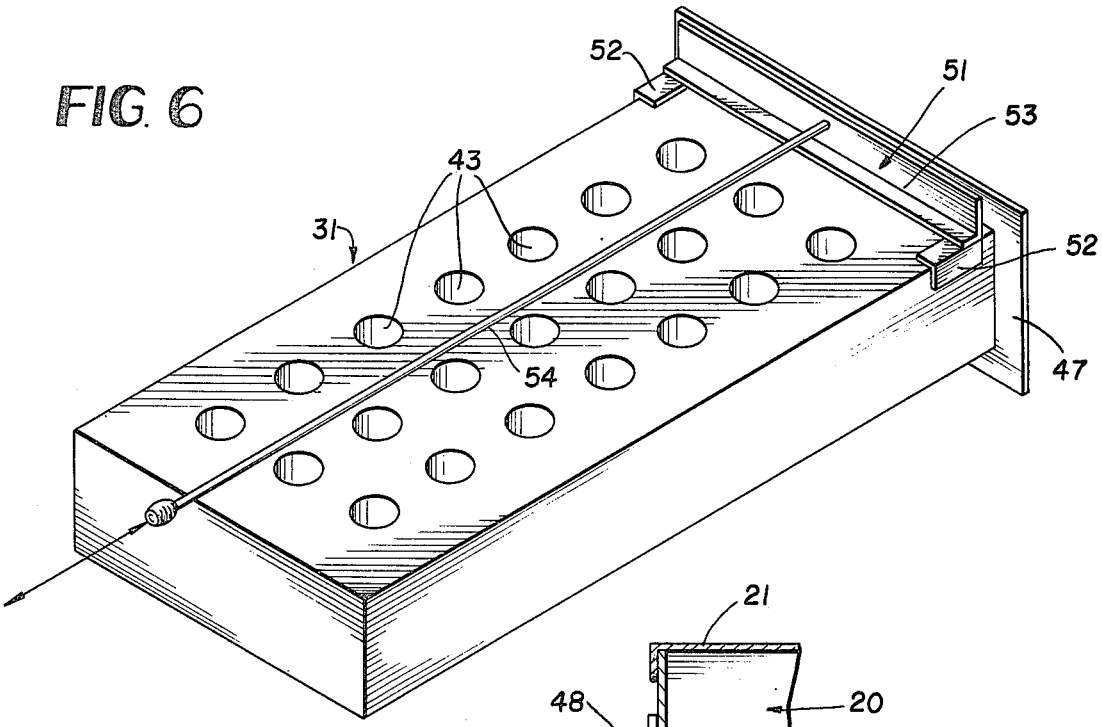
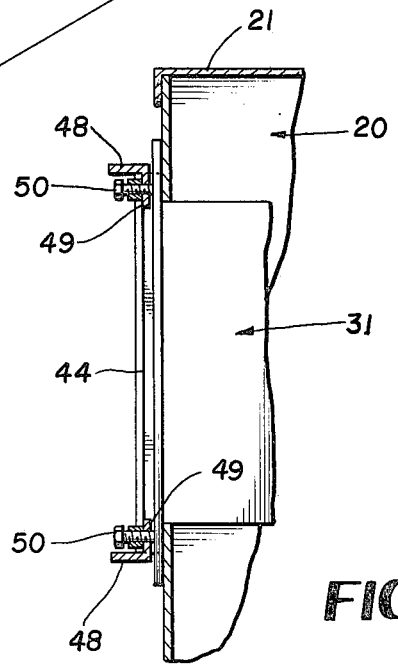
FIG. 7
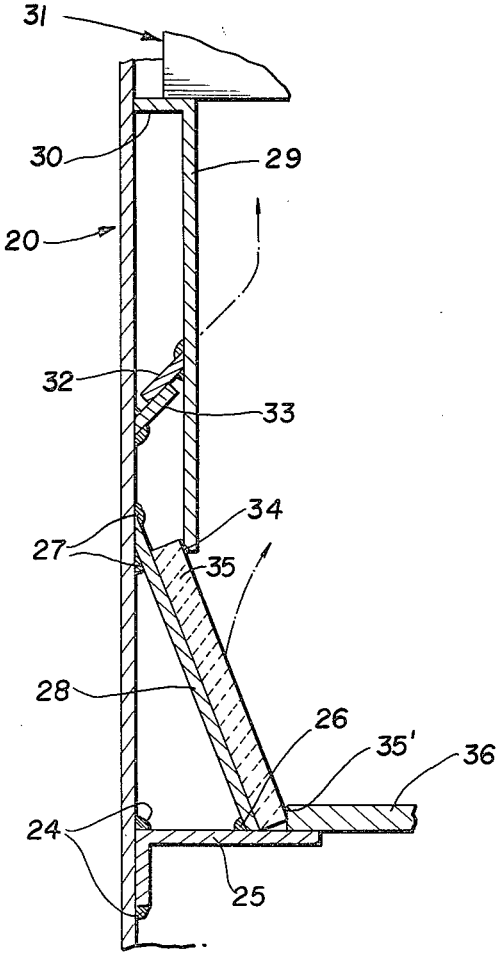
FIG. 8

DOMESTIC BOILER

CROSS-REFERENCE TO RELATED APPLICATION

This application is a continuation-in-part of copending application Ser. No. 964,432, filed Nov. 28, 1978, for BOILER FOR DOMESTIC HEATING SYSTEMS.

BACKGROUND OF THE INVENTION

The referenced prior patent application discloses a domestic boiler having a refractory lined firebox and grate, an overhead front-to-back sliding and removable boiler module having vertical fire tubes and a surrounding water chamber, and a removable ash drawer at the bottom of the boiler. The rectangular boiler included a thermally insulated wall, and appropriate supports, guides and fasteners were provided for internal components of the boiler.

While the boiler in the prior application proved perfectly sound from the standpoint of operational efficiency and convenience of use, it left something to be desired in terms of compatibility with mass production techniques and was particularly lacking in ease of assembly because of the necessity for installation of certain fasteners and somewhat difficult welding procedures on a mass production basis.

The objective of the present invention is to improve on and simplify the boiler in accordance with the prior application, most particularly in terms of facilitating its assembly and completely eliminating the necessity for bolting internal components. In accordance with a key feature of the invention, certain side protectors used within the boiler are merely dropped into place with previously inserted front and back protectors and serve therewith to position and retain the proper number of fire bricks along each side of the boiler, the latter being further stabilized and positioned by a flat grate at the bottom of the fire box resting on primary welded support flanges. The drop-in side protectors also form horizontal guide rails for the slide-in, slide-out boiler power module and a strong and positive easily releasable clamping retainer means for this module is included on the back wall of the boiler. All key parts are easily installed and removed through the back wall opening which receives the slide-in, slide-out module. The front, back and side protectors which drop easily into place in the boiler shell also interfit to position one another and to positively confine the fire bricks in the front-to-back direction.

A very important feature of the invention is that the boiler side protectors become the key to establishing and changing boiler size. The length of the boiler is increased front-to-back by adding side protectors and additional fire bricks, as desired. The structure is highly practical from a manufacturing and ease of assembling standpoint, is very sturdy and comparatively low cost. The internal protectors can be cast iron or molded refractory material, or a combination of such material, with suitable cast iron inserts.

Another significant improvement feature over the structure in the referenced application is the provision in the boiler of a built-in easily operated scraper for the top of the boiler module and a convenient portable boiler tube cleaner.

Other objects and advantages of the invention will become apparent during the course of the following description.

BRIEF DESCRIPTION OF THE DRAWINGS

FIG. 1 is a front perspective view of a boiler according to the invention.

FIG. 2 is a transverse vertical section through the boiler taken on line 2—2 of FIG. 1.

FIG. 5 is a fragmentary rear perspective view of the boiler showing retainer means for the slide-in, slide-out boiler power module.

FIG. 6 is a perspective view of the boiler module and associated scraper means.

FIG. 7 is an enlarged fragmentary vertical section taken on line 7—7 of FIG. 5.

FIG. 8 is an enlarged fragmentary vertical section taken through the side protector, fire bricks and grate support.

DETAILED DESCRIPTION

Figure 3:
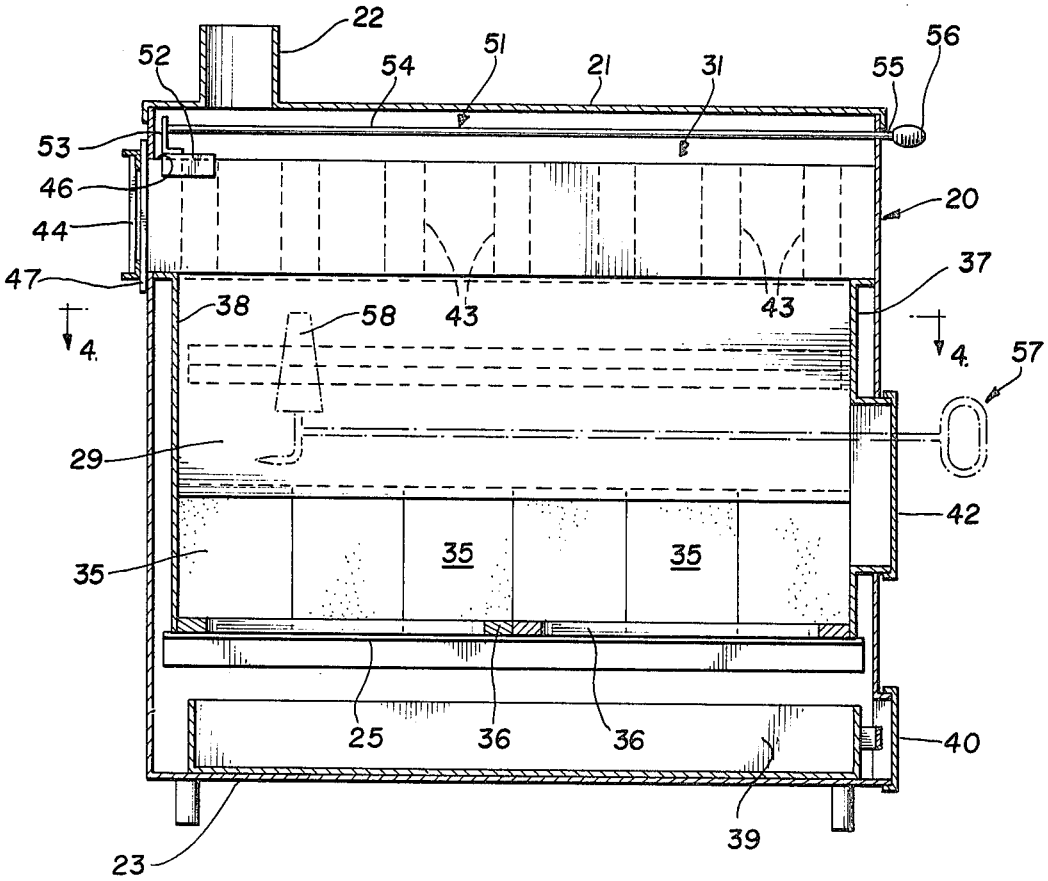
FIG. 3 is a longitudinal section taken on line 3—3 of FIG. 2.

Referring to the drawings in detail wherein like numerals designate like parts, a rectangular domestic boiler includes an outer shell 20 or housing preferably having a lift-off top cover plate 21 including a smoke pipe fitting 22. In contrast to the boiler in the prior referenced application, the shell or housing 20 is not a double walled structure having thermal insulation but, instead, is a single thickness shell of rectangular formation.

Fixed to the opposite side walls of the shell 20 somewhat above its bottom wall 23 by welding as at 24 are sturdy horizontal front-to-back grate and fire brick support flanges 25 in the form of angle members. As shown in FIG. 3, the support flanges or members 25 extend substantially for the entire distance between the vertical front and back walls of the shell 20. The inner longitudinal edges of the flanges 25 are parallel and spaced apart widely in the boiler, FIG. 2.

Welded at 26 to the tops of flanges 25 and to the interior surfaces of the side walls of shell 20 at 27 are inclined fire brick rest plates 28. These rest plates are steeply inclined preferably at about 75 degrees to the horizontal. They extend continuously in the front-to-back direction along the interior of the boiler shell 20 at both sides thereof and with the flanges 25 and shell side walls form very rigid support units in the boiler.

Readily insertable and removable side protectors 29 form key elements in the boiler and lie inwardly of the shell side walls equal distances determined by the widths of top horizontal front-to-back spacer flanges 30, also serving as guide and support tracks for a slide-in, slide-out boiler power module 31, to be further described. The side protectors 29 have inclined hanger plates 32 welded to their outer faces and being arranged to rest on similarly inclined support plates 33 welded to the side walls of shell 20 somewhat above the rest plates 28.

As best shown in FIG. 8, when vertical side protectors 29 are slipped into place, they become parallel to the shell side walls with their top flanges 30 in contact with the shell and the hanger and support plates 32 and 33 in sliding contact. The lower longitudinal edges 34 of side protectors 29 will lap the upper edges and inner faces of fire bricks 35 resting on flanges 25 and plates 28. The fire bricks are thus retained in position against the rest plates 28 by the lower edges of side protectors 29 and by the longitudinal front-to-back edges 35' of grates 36 which rest solidly and horizontally on the flanges 25. A very secure assembly is created for these parts without the use of any bolts or like fasteners. The key internal parts of the boiler in effect are made to become self-supporting in assembly and are very easy to install and separate.

In addition to serving as retainers for the fire bricks 35 and supporting guideways for the sliding boiler module 31, the side protectors 29 establish the size of the boiler and allow the boiler to be expanded in the front-to-back direction to any necessary size in order to meet power requirements. To expand the size of the boiler from its basic unit size, it is merely necessary to add additional side protectors 29 and fire bricks 35 along the two sides of the boiler. The provided construction is versatile and convenient.

Figure 4:
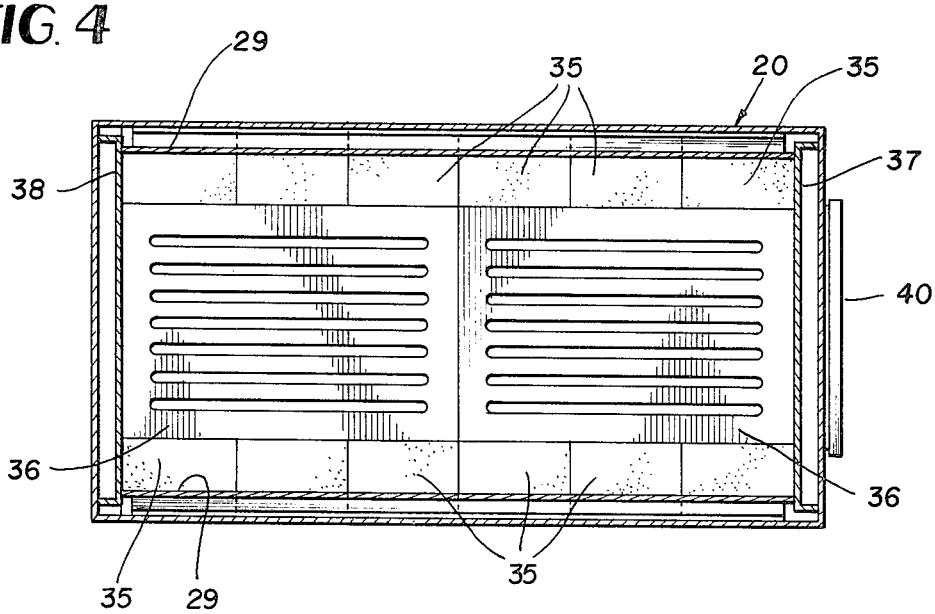
FIG. 4 is a horizontal section taken on line 4—4 of FIG. 3.

In conjunction with the side protectors 29 and associated parts, front and back protectors 37 and 38 of the slip-in, pull-out type are also provided in the improved structure. As shown in FIG. 3, the front and back protectors 37 and 38 rest on support flanges 25. As shown in FIG. 4, the vertical front and back protectors 37 and 38 are notched into side protectors 29 at the vertical corners of the boiler to position all of the protectors in a rectangular array positively and to prevent front-to-back displacement of the fire bricks 35 at each side of the boiler while maintaining them in side-by-side abutment without fastener means. Both the side and the front and back protectors 29, 37 and 38 fit snugly in assembled relationship inside of the rectangular shell 20 and can be installed and removed very readily as they are simply dropped into place. In the assembly process, the front and back protectors are first slipped into place, followed by the side protectors 29. The fire bricks 35 are then installed beneath the side protectors and are finally locked into place when the grate 36 is placed on support flanges 25. This completes the assembly of the main internal components of the boiler.

As with the referenced application, the boiler has a slide-in, slide-out ash drawer 39 below the grate 36 and flanges 25. This ash drawer is removed through a front door 40 near the bottom of the boiler equipped with an electrically operated draft control 41. A main front door 42 opening into the front of the fire box above the grate is provided, as in the prior application.

The slide-in, slide-out power module 31 is essentially the same as in the referenced application including multiple, vertical open-ended fire tubes 43 surrounded by a closed rectangular water chamber. As stated, the module 31 slides horizontally on the top flanges 30 of side protectors 29 and the previous necessity for separate guide rails for the module 31 is eliminated.

Another important aspect of the invention is the provision of a positive and strong retainer means for the module 31 on the boiler. This means comprises a pair of opposite side parallel vertical angle bars 44 having their side webs 45 welded to the back wall of boiler shell 20 on opposite sides of the rear opening 46 which receives the boiler module 31, FIG. 3. The module 31 includes a rear flange plate 47 which abuts the rear face of the shell 20 when the module 31 is fully engaged in the boiler shell, FIG. 3, with its forward end above front protector 37. A pair of horizontal transverse parallel separable retaining angle bars 48 have their vertical flanges 49 engaging forwardly of the fixed angle bars 44 and rearwardly of the sliding module flange plate 47. Clamping set screws 50 threadably engaged with angle bars 48 and bearing on module flange plate 47 are employed to releasably clamp the boiler module 31 in its normal use position. The arrangement is very secure, adds rigidity to the structure and makes for ease of assembly and maintenance. FIG. 5 shows various plumbing outlet fittings in the flange plate 47 at the rear of boiler module 31 which per se are not part of the present invention.

The invention has for another of its features a built-in safe and easily operated scraper unit 51 to remove soot or other solids from the top face of boiler module 31 so as to avoid blocking the fire tubes 43. This scraper unit comprises a pair of short angle runners 52 which ride on the upper square corners of rectangular module 31 and are rigidly interconnected by a transverse scraper bar 53 lying close to the top face of the module. A front-to-back horizontal scraper operating rod 54 is fixed to the center of scraper bar 53 and passes forwardly between the top of the module 31 and cover plate 21 and through a small guide opening 55 in the front wall of shell 20. The forward end of rod 54 is equipped with a convenient operating knob 56 and the scraper is operated by an attendant at the front of the boiler. Additionally, a poker 57 shown in phantom lines in FIG. 3 is provided for the convenience of the user having an upright forward end cleaning brush 58 which can be inserted into the bores of fire tubes 43 periodically to clean them.

It can now be seen that a more simplified and convenient mode of assembly has been provided in a boiler of the type shown in the referenced application allowing the front-to-back size of the boiler to be changed at will and eliminating the need for bolting internal components. As described, these components are simply slipped into place and lifted out, when required, and coact in assembly with the assistance of gravity to support and stabilize themselves. The unique side protectors 29, in addition to establishing the size of the boiler, lock the replaceable fire bricks in place with the assistance of the grates 36 and support and guide the sliding module 31. Simplicity of construction, economy of manufacturing, and convenience of assembly and maintenance are enhanced.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A boiler comprising a shell having side walls and a rear opening, a grate support in the shell at an elevation below said rear opening, a grate resting on the grate support and having side edges, inclined fire bricks arranged near opposite sides of the shell and within the shell and extending above the grate support and grate and having lower edges resting on the grate support and being captively engaged by the side edges of the grate, a pair of internal side protectors for the boiler above the fire bricks and within the shell and having lower edges which lap top edges of the fire bricks to retain them in place, camming hanger means for the side protectors on the shell and side protectors and supporting the side protectors in the shell and causing their lower edges lapping the fire bricks to maintain retaining pressure on the fire bricks, and top flanges on the side protectors forming supporting guideways for a front-to-back sliding boiler module engaged within said rear opening of said shell.

2. A boiler as defined in claim 1, and cooperative front and back protectors for the boiler resting on said grate support within said shell and being in interfitting engagement with said side protectors at corners of the shell to maintain a rectangular array of the side, front and back protectors, the front and back protectors also serving to block front-to-back displacement of the fire bricks in the boiler.

3. A boiler as defined in claim 1, and said grate support comprising a pair of laterally spaced front-to-back extending support flanges on the opposite side walls of the shell.

4. A boiler as defined in claim 3, and inclined rest plates for fire bricks above said support flanges having their lower edges anchored to the support flanges along lines spaced from the front-to-back edges of the support flanges and having their upper edges anchored to the side walls of the shell, the side walls of the shell, support flanges and rest plates forming within opposite sides of the shell rigid triangular support frames for the grate and fire bricks of the boiler.

5. A boiler as defined in claim 4, and said rest plates and fire bricks being disposed at angles of roughly 75 degrees to the horizontal.

6. A boiler as defined in claim 1, and said top flanges on the side retainers serving to space the side protectors from the adjacent side walls of the shell to form air spaces, and said camming hanger means comprising front-to-back extending inclined coacting support plates fixed to the side walls of the shell and hanger plates fixed to the side protectors within the air spaces.

7. A boiler as defined in claim 1, and releasable retainer means for said sliding boiler module at said rear opening, said module having a flange plate at its rear end abuttable with the rear wall of the boiler shell, a pair of fixed retainer bars on the rear wall of the shell at opposite sides of the rear opening, a pair of releasable retainer bars at the top and bottom of the rear opening engaging rearwardly of said flange plate and engaging forwardly of the fixed retainer bars, and clamping set screw means on the releasable retainer bars adapted to bear against said flange plate.

8. A boiler as defined in claim 1, and a built-in scraper for the boiler comprising a scraper bar slidably engaged with and extending across the top of said boiler module within said shell and having a front-to-back operating rod guidably engaged with said shell and extending outside of the shell.

9. A boiler as defined in claim 1, and an ash compartment in said shell below said grate and grate support, and a removable ash drawer in said ash compartment.

* * * * *